US010377166B2

(12) United States Patent
Kim

(10) Patent No.: US 10,377,166 B2
(45) Date of Patent: Aug. 13, 2019

(54) KNOCK TYPE PEN

(71) Applicant: DONG-A PENCIL CO., LTD., Seoul (KR)

(72) Inventor: Hakjae Kim, Seoul (KR)

(73) Assignee: DONG-A PENCIL CO., LTD., Seoul (KR)

( * ) Notice: Subject to any disclaimer, the term of this patent is extended or adjusted under 35 U.S.C. 154(b) by 46 days.

(21) Appl. No.: 15/856,904

(22) Filed: Dec. 28, 2017

(65) Prior Publication Data

US 2019/0160853 A1 May 30, 2019

(30) Foreign Application Priority Data

Nov. 24, 2017 (KR) ..... 10-2017-0158434

(51) Int. Cl.

| | |
|---|---|
| ***B43K 24/06*** | (2006.01) |
| ***B43K 24/04*** | (2006.01) |
| ***B43K 7/12*** | (2006.01) |
| ***B43K 24/02*** | (2006.01) |
| ***B43K 24/08*** | (2006.01) |

(52) U.S. Cl.

CPC ..... *B43K 24/06* (2013.01); *B43K 7/12* (2013.01); *B43K 24/02* (2013.01); *B43K 24/084* (2013.01)

(58) Field of Classification Search

CPC ..... B43K 24/06; B43K 7/12; B43K 24/08; B43K 24/02; B43K 24/026; B43K 24/04; B43K 24/00; B43K 24/023; B43K 24/03; B43K 24/082; B43K 24/084

See application file for complete search history.

(56) References Cited

U.S. PATENT DOCUMENTS 2,593,365 A * 4/1952 Thull ..... B43K 24/08 401/112
2,882,859 A * 4/1959 Poritz ..... B43K 7/00 401/109
3,408,148 A * 10/1968 Bross ..... B43K 24/08 401/113

FOREIGN PATENT DOCUMENTS

KR 20-2016-0003130 9/2016

* cited by examiner

*Primary Examiner* — David J Walczak

(57) ABSTRACT

A knock type pen including a housing, a lead which is received in the housing and has an end to which a nib is coupled, and a knock element which protrudes from top of the housing and is pushed, a regulating element which is rotatably installed on an outer circumference of the housing, and a locking element which is provided in the housing and moves up and down by rotation of the regulating element, wherein when the locking element moves up, a press of the knock element is limited by the locking element.

3 Claims, 7 Drawing Sheets

< Prior Art >

< Prior Art >

< Prior Art >

< Prior Art >

KNOCK TYPE PEN

CROSS-REFERENCE TO RELATED APPLICATION

This application claims priority of Korean Patent Application No. 10-2017-0158434, filed on Nov. 24, 2017, in the KIPO (Korean Intellectual Property Office), the disclosure of which is incorporated herein entirely by reference.

BACKGROUND OF THE INVENTION

Field of the Invention

The present disclosure relates to a knock type pen, and more particularly, to a knock type pen for preventing ink from leaking through the nib pushed out by a user's unintentional knock pressing and leaving stains on clothes or a bag.

Description of the Related Art

In general, a pen can be classified into a fixed type pen in which the lead is fixed and the nib is exposed to the outside or concealed using an opening/closing cap, a rotary type pen in which as a part of the shaft rotates, the lead makes a linear movement and accordingly the nib is pushed in and out, a knock type pen in which when a part of the shaft is pressed, a spring moves to push the nib out, and a slide type pen in which the lead slides the nib to push the nib in and out.

Among them, the knock type pen is convenient because of pushing the nib in and out in a simple manner through a motion of pressing a button section provided on the top of a housing. This knock type pen is configured such that when the button section provided on the top of the housing is pressed once, the nib extends outside, turning into a writable state, and when the button section is pressed once again, the extended nib retracts into the housing, turning into a reception and protection state.

FIG. 1 is a diagram showing a conventional knock type pen, and FIG. 2 is an exploded view of a knock mechanism of the knock type pen of FIG. 1. As shown in FIG. 1, the conventional knock type pen 10 is configured such that a lead 12 storing ink is received in a housing 11, and a knock body 15 which is manipulated moveably up and down is protrusively coupled to a slot (not shown) formed on the inner sidewall of the housing 11 in the upper part of the housing 11. Furthermore, a rotary cam 16 is rotatably placed between the lead 12 and the knock body 15, and the knock body 15 and the rotary cam 16 form a knock mechanism 14 whereby the lead 12 is allowed to advance and draw back.

Moreover, a spring 21 is placed between the housing 11 and the lead 12 to apply an elastic force to the lead 12 in a direction in which the nib 13 retracts into the housing 11. When a user presses a button section 17 protruding out of the housing 11 of the knock body 15, the lead 12 moves down and the nib 13 protruding at the end is pushed out of the housing 11. In this instance, a guide protrusion 20 of the rotary cam 16 that comes into contact with a toothed protrusion 18 at the bottom of the knock body 15 slips out of the slot of the housing 11, and at the same time, slips out of one slope surface of the toothed protrusion 18 while rotating along the other slope surface, and the rotated guide protrusion 20 of the rotary cam 16 is stuck by a stopper step 19 protruding from the outer circumference of the knock body 15. In this state, despite the elastic force of the spring 21 coupled to the nib 13, the lead 12 does not move up, so the nib 13 keeps being extended outside the housing 11. When the nib 13 is extended outside, if the user presses the button section 17 again, the rotary cam 16 rotates by the method previously described so that the guide protrusion 20 of the rotary cam 16 is disposed between the stopper steps 19 of the knock body 15 and moves up by the elastic force of the spring 21 and thus the nib 13 retracts into the housing 21.

However, the conventional knock type pen designed as above has a problem that when it is put on the user's clothes, for example, a pocket using a clip 22 provided on the side of the upper end of the housing 11 as shown in FIG. 3, or when it is put in a bag as shown in FIG. 4, the nib 13 is pushed out by the user's unintentional knock pressing, and ink leaks through the nib 13 extended outside, causing ink stains on the clothes or the bag.

In particular, recently, many knock type pens containing low viscosity ink of 300-3,000 cps to facilitate writing with a small force (pressure) are being offered. However, compared to high viscosity ink of 10,000-25,000 cps, low viscosity ink leaks in a higher amount from the nib due to the low viscosity, and when the nib is pushed out by an unintentional knock pressing as described above, larger ink stains leave on clothes or a bag because of better ability of absorption, resulting in more serious damage.

Korean Utility Model Publication No. 20-2016-0003130, published on Sep. 19, 2016, discloses a knock type pen.

SUMMARY OF THE INVENTION

The present disclosure is designed to solve the problem such as the foregoing, and therefore the present disclosure is directed to providing a knock type pen for preventing ink from leaking through the nib pushed out by a user's unintentional knock pressing and leaving stains on clothes or a bag.

Meanwhile, other objects not stated herein will be additionally considered within the range in which inference is easily made from the detailed description and the effects as described below.

To achieve the object, a knock type pen according to the present disclosure includes a housing, a lead which is received in the housing and has an end to which a nib is coupled, and a knock element which protrudes from top of the housing and is pushed, a regulating element which is rotatably installed on an outer circumference of the housing, and a locking element which is provided in the housing and moves up and down by rotation of the regulating element, wherein when the locking element moves up, a press of the knock element is limited by the locking element.

Preferably, a guide groove of an oblique line may be formed on an inner circumference of the regulating element, and the locking element may include a blocking section which has a through hole at the center and is installed in an inner side of the housing, and a protrusion which protrudes from an outer side of the blocking section and is inserted into the guide groove of the regulating element, and may be installed in the housing to make a linear motion upward and downward, and when the regulating element rotates, the locking element may move up and down by the protrusion inserted into the guide groove.

More preferably, the guide groove may have a movement section of an oblique line and a fixing section bent downward from top of the movement section.

The knock type pen according to the present disclosure is configured such that when the locking element is moved up by rotation of the regulating element, one side of the knock element comes into contact with one side of the locking element and upward and downward movements are limited, and when the locking element is moved down by rotation of the regulating element, a space between the knock element and the locking element is ensured, allowing the knock element to move up and down freely. Accordingly, when the locking element is moved down, the nib is freely extended out of the housing for use by making use of the pressing of the knock element, and when the locking element is moved up, the downward movement of the knock element is limited by the upward moved position of the locking element, so when the knock type pen is non-use, even though an unintended force is applied to the knock element, the knock element does not move, thereby preventing the nib from being unintentionally pushed out.

In particular, in the case of use from low viscosity ink of 300-3,000 cps having relatively low viscosity to high viscosity ink of 10,000-25,000 cps having high viscosity, even though the knock element is pressed, the movement of the knock element is limited by the locking element, thereby preventing ink from leaking out of the nib and leaving stains on clothes or a bag, and it can be applied to all writing instruments such as ballpoint pens employing low viscosity ink and high viscosity ink.

BRIEF DESCRIPTION OF THE DRAWINGS

The above and other features and advantages will become more apparent to those of ordinary skill in the art by describing in detail exemplary embodiments with reference to the attached drawings, in which.

Figure 1:
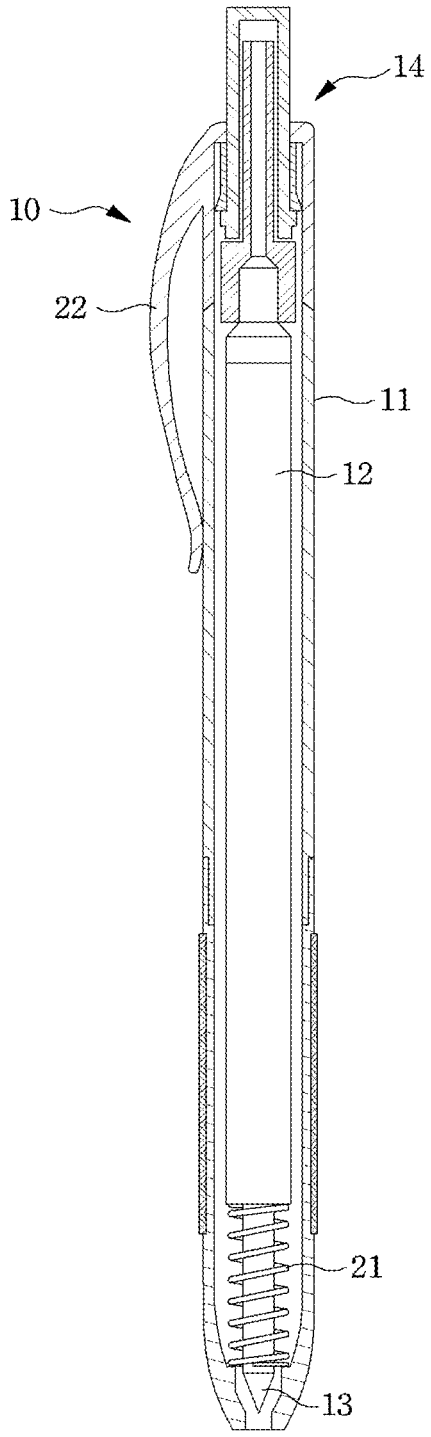
FIGS. 1 and 2 are a cross-sectional view and an exploded perspective view showing the configuration of the conventional knock type pen.
Figure 2:
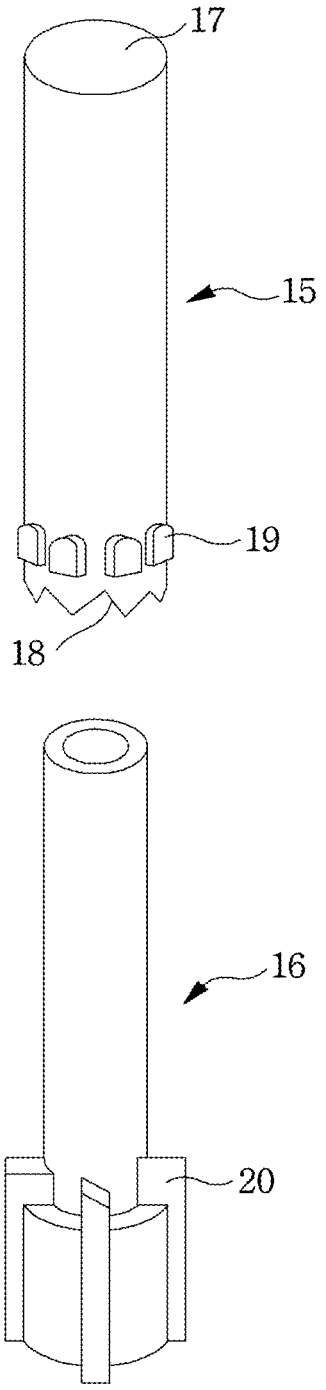
Figure 3:
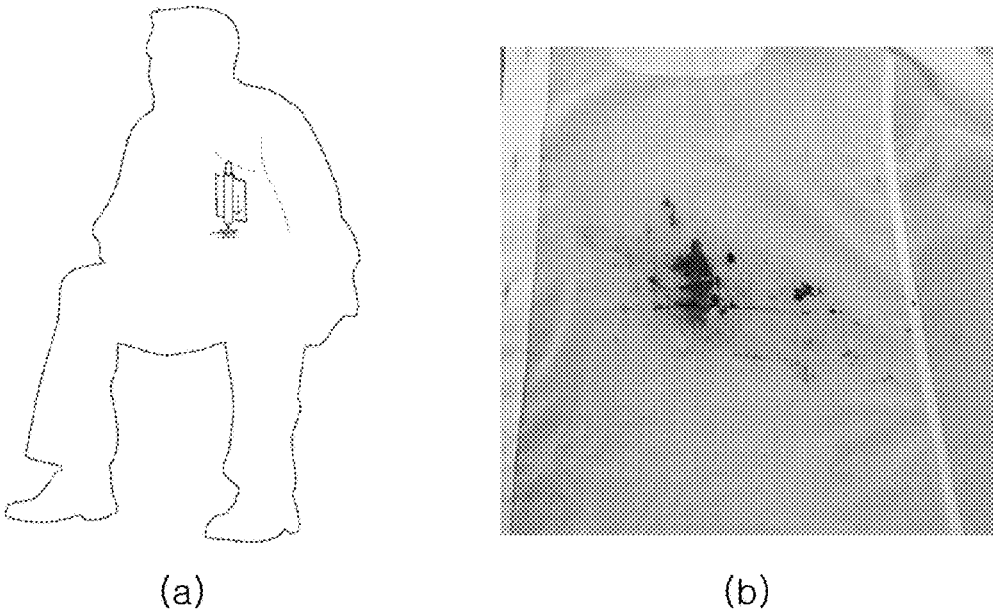

(a) in FIG. 3 is a diagram showing an example of inadvertent operation that the nib is pushed out by the pressing of an unintentional knock when the conventional knock type pen is put on the pocket, and (b) in FIG. 3 is a photographic diagram showing an example of ink contamination on fabric caused by inadvertent operation of the conventional knock type pen.

Figure 4:
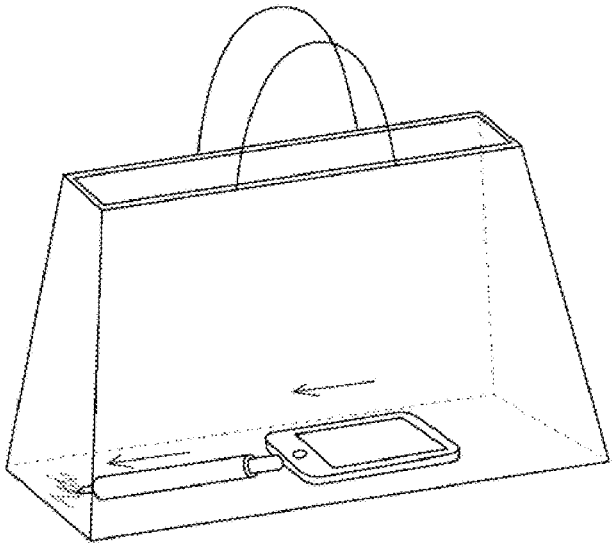

FIG. 4 is a diagram showing an example of inadvertent operation that the nib is pushed out by the pressing of an unintentional knock when the conventional knock type pen is put in a bag.

Figure 5:
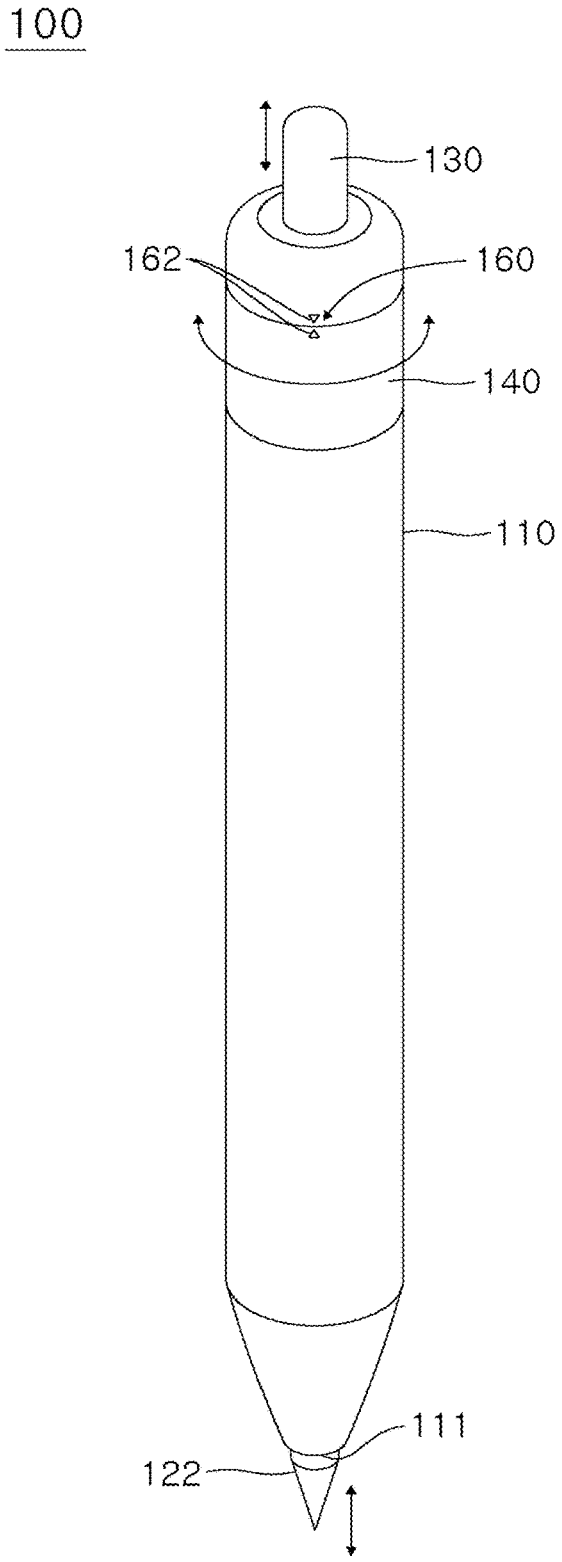

FIG. 5 is a perspective view of a knock type pen according to an embodiment of the present disclosure.

Figure 6:
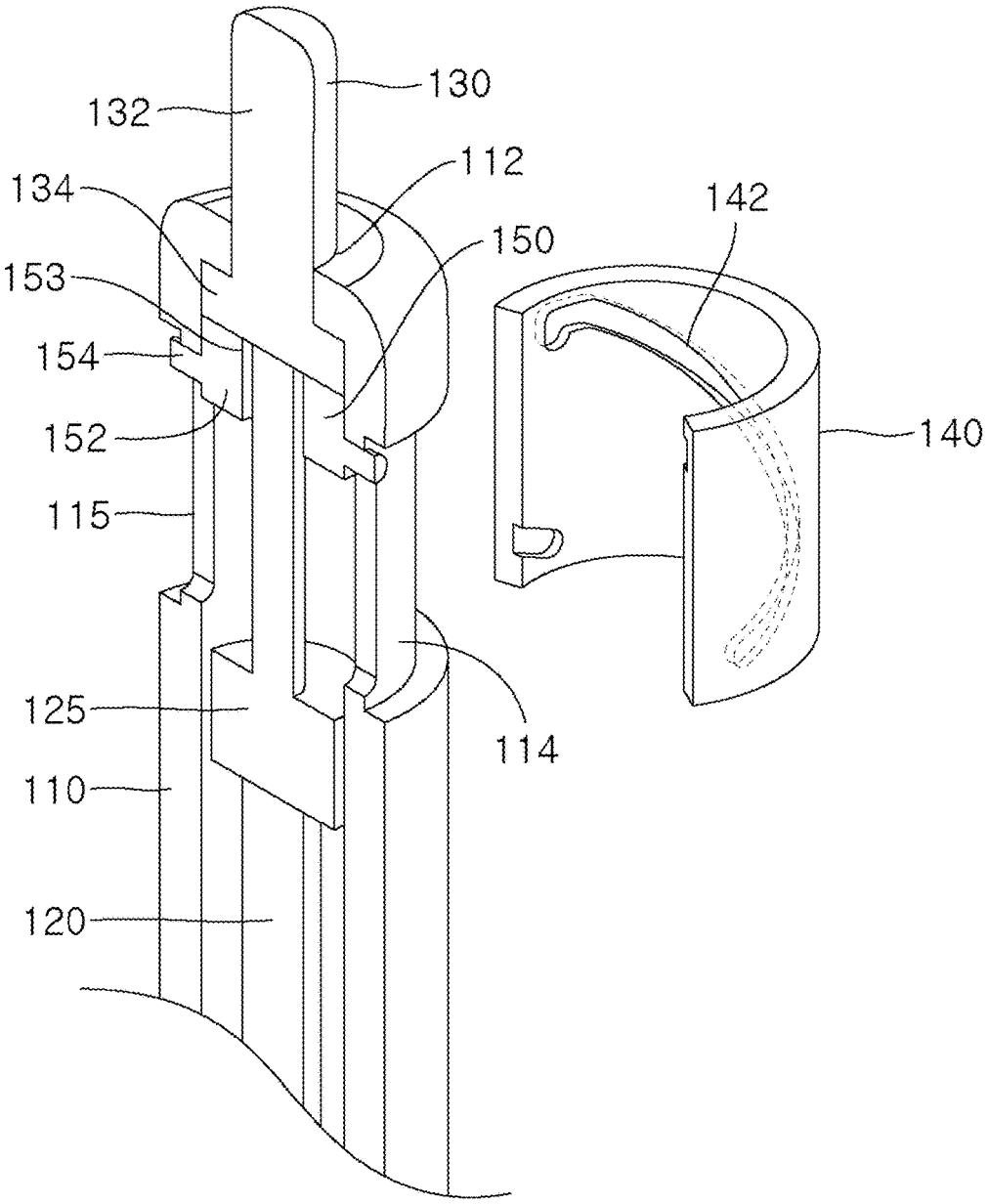

FIG. 6 is a partial cutaway perspective view of a knock type pen according to an embodiment of the present disclosure.

Figure 7:
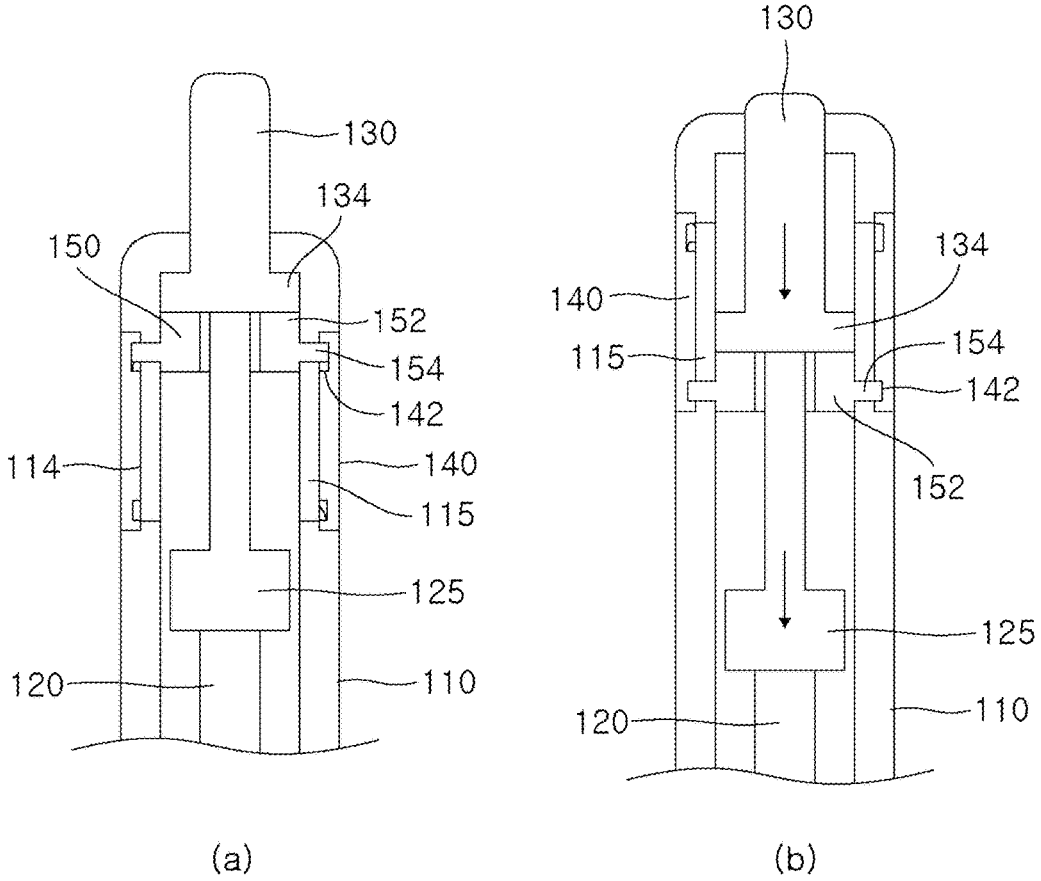

(a) and (b) in FIG. 7 are partial horizontal cross-sectional views of a knock type pen according to an embodiment of the present disclosure.

Figure 8:
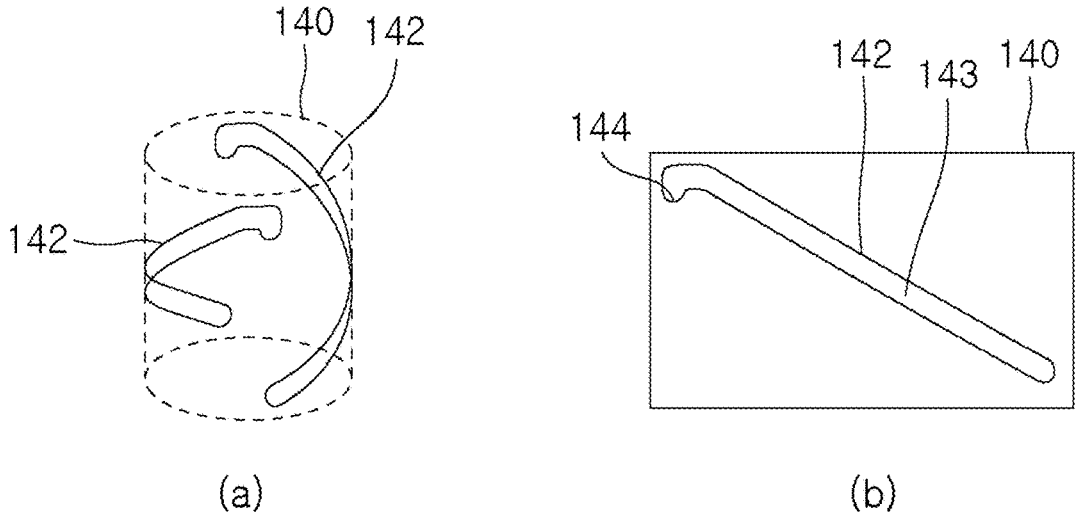

(a) in FIG. 8 is a diagram showing stereoscopic representation of guide groove shape, the guide groove formed on the inner side of a regulating element according to an embodiment of the present disclosure, and (b) is a diagram showing the representation of guide groove shape on the plane, the guide groove formed on the inner side of the regulating element.

In the following description, the same or similar elements are labeled with the same or similar reference numbers.

DETAILED DESCRIPTION

The present invention now will be described more fully hereinafter with reference to the accompanying drawings, in which embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "includes", "comprises" and/or "comprising," when used in this specification, specify the presence of stated features, integers, steps, operations, elements, and/or components, but do not preclude the presence or addition of one or more other features, integers, steps, operations, elements, components, and/or groups thereof. In addition, a term such as a "unit", a "module", a "block" or like, when used in the specification, represents a unit that processes at least one function or operation, and the unit or the like may be implemented by hardware or software or a combination of hardware and software.

Reference herein to a layer formed "on" a substrate or other layer refers to a layer formed directly on top of the substrate or other layer or to an intermediate layer or intermediate layers formed on the substrate or other layer. It will also be understood by those skilled in the art that structures or shapes that are "adjacent" to other structures or shapes may have portions that overlap or are disposed below the adjacent features.

In this specification, the relative terms, such as "below", "above", "upper", "lower", "horizontal", and "vertical", may be used to describe the relationship of one component, layer, or region to another component, layer, or region, as shown in the accompanying drawings. It is to be understood that these terms are intended to encompass not only the directions indicated in the figures, but also the other directions of the elements.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Preferred embodiments will now be described more fully hereinafter with reference to the accompanying drawings. However, they may be embodied in different forms and should not be construed as limited to the embodiments set forth herein. Rather, these embodiments are provided so that this disclosure will be thorough and complete, and will fully convey the scope of the disclosure to those skilled in the art.

First, FIG. 5 is a perspective view of a knock type pen according to an embodiment of the present disclosure, and FIG. 6 is a partial cutaway perspective view of a knock type pen according to an embodiment of the present disclosure.

Describing with reference to FIGS. 5 and 6, the knock type pen 100 according to an embodiment of the present disclosure includes a housing 110, a lead 120 that is received in the housing 110 and has an end to which a nib 122 is coupled, a knock element 130 that protrudes from the top of the housing 110 and is pushed, a regulating element 140 that is installed rotatably on the outer circumference of the housing 110, and a locking element 150 that is provided in the housing 110 and moves up and down with the rotation of the regulating element 140.

The housing 110 is hollow inside, and has a hollow nib exit 111 and a hollow knock element exit 112 at each of the two ends. The housing 110 is manufactured with a predetermined length, and has a working section 114 with which the regulating element 140 is engaged at the upper part. The working section 114 is provided along the circumference of one point of the upper part of the housing 110. The working section 114 has steps at the upper and lower sides in the shape of a groove recessed inward from the outer surface of the housing 110. The working section 114 has a movement slit 115 in the shape of a straight line running vertically. The movement slit 115 is where a protrusion 154 of the locking element 150 as described below passes through, and is perforated to connect the inside and the outside of the housing 110. At least one movement slit 115 is provided along the circumference of the working section 114, and most preferably, a pair of movement slits 115 is provided, each one disposed in a position facing each other.

The lead 120 is received in the housing 110. The top of the lead 120 is connected to the knock element 130 through a knock mechanism 125. As described previously in the 'background' part, the knock mechanism 125 is engaged on the top of the lead 120, and the knock mechanism 125 is a device that controls the upward/downward movement of the lead 120 through the action of a guide protrusion, a knock body, and a rotary cam in the housing 110, and its configuration and operation is not the feature of the present disclosure and is technology known in the art, and thus its detailed description is omitted herein. The operation of the knock mechanism 125 is accomplished by a pressing operation of the knock element 130, and as described above, when the knock element 130 is pressed once, the lead 120 is moved down by the knock mechanism 125, and when the knock element 130 is pressed once again, the lead 120 is moved up by the action of a spring (not shown) that elastically supports the knock mechanism 125 and the lead 120 upward.

The nib 122 through which ink stored in the lead 120 is discharged is coupled to the bottom of the lead 120. The nib 122 operates such that it can move up and down together with the lead 120 by the action of the knock mechanism 125, and enter and exit from the nib exit 111 at the bottom of the housing 110.

The knock element 130 is connected to the top of the knock mechanism 125 engaged on the top of the lead 120. An obstruction section 134 which is the lower part of the knock element 130 is received in the housing 110, and a pressing section 132 which is the upper part protrudes outward through the knock element exit 112 on the top of the housing 110. Meanwhile, although this embodiment shows that the top of the knock mechanism 125 is connected to the obstruction section 134 of the knock element 130, the present disclosure is not limited thereto, and when a connecting rod (not shown) in a pillar shape protrudes from the obstruction section 134 of the knock element 130, the knock mechanism 125 may be engaged to the bottom of the connecting rod (not shown).

Meanwhile, as described above, the conventional knock type pen causes an incident of ink contamination on clothes or a bag, because the knock element is pressed by an unintended force while in non-use, and the nib is pushed out of the bottom of the housing by the pressing of the knock element. Accordingly, to solve this problem, the knock type pen 100 according to the present disclosure is configured to limit the downward movement of the knock element 130 using the regulating element 140 and the locking element 150.

(a) in FIG. 8 is a diagram showing stereoscopic representation of the shape of the guide groove formed on the inner side of the regulating element according to an embodiment of the present disclosure, and (b) is a diagram showing the representation of guide groove shape on the plane, the guide groove formed on the inner side of the regulating element.

Describing with reference to FIGS. 5, 6 and 8, the regulating element 140 is in a cylindrical shape having a hollow inner part and open top and bottom. The regulating element 140 is engaged surrounding the working section 114 formed on the outer side of the upper end part of the housing 110, and operates rotatably on the circumference of the housing 110. The regulating element 140 has a guide groove 142 in the shape of an oblique line on the inner surface, and a pair of guide grooves 142 is formed in a direction in which they face each other along the inner circumference of the regulating element 140. The pair of guide grooves 142 is arranged staggeredly in the oblique direction. In this instance, the number of the guide grooves 142 preferably corresponds to the number of movement slits 115 of the working section 114 and the number of protrusions 154 of the locking element 150.

The guide groove 142 includes a movement section 143 that extends in the shape of an oblique line along the top and bottom of the inner surface of the regulating element 140, and a fixing section 144 that is bent from the top of the movement section 143 and extends downward. The protrusion 154 of the locking element 150 as described below is inserted into the guide groove 142, and the protrusion 154 is moved up and down by the guide groove 142 when the regulating element 140 rotates.

(a) and (b) in FIG. 7 are partial horizontal cross-sectional views showing the operation of the knock type pen according to an embodiment of the present disclosure. Describing with reference to FIGS. 6 and 7, when the regulating element 140 rotates, the locking element 150 is moved up and down from the housing 110 by the guide groove 142 of the regulating element 140. The locking element 150 includes a blocking section 152 that is received in the housing 110 and has a through hole 153 at the center, and the protrusion 154 that protrudes from the side surface of the blocking section 152 and is inserted into the guide groove 142 of the regulating element 140 through the movement slit 115 of the housing 110.

The locking element 150 is fixed to make a linear motion upward and downward from the housing 110 as the protrusion 154 passes through the movement slit 115 extending in a straight line along the upward and downward directions. As above, when the locking element 150 is engaged with the movement slit 115 of the housing 110 to make a linear motion upward and downward, if the regulating element 140 rotates, an intersection position of the movement slit 115 of a straight line and the guide groove 142 of an oblique line is moved up or down, and thus, with the protrusion 154 inserted into the guide groove 142 through the movement slit 115, the locking element 150 moves up or down as the regulating element 140 rotates. Additionally, when the locking element 150 is moved down, if the regulating element 140 is rotated in a direction, the locking element 150 moves up, and when the locking element 150 is moved up, if the regulating element 140 is rotated back in the opposite direction to the initial rotation direction, the locking element 150 moves down.

When the locking element 150 is moved up by the rotation of the regulating element 140, the obstruction section 134 of the knock element 130 comes into contact with the blocking section 152 of the locking element 150 and its upward and downward movement is limited, and when the locking element 150 is moved down by the rotation of the regulating element 140, a space between the obstruction section 134 of the knock element 130 and the blocking section 152 of the locking element 150 is ensured, allowing the knock element 130 to move up and down freely. Accordingly, when the locking element 150 is moved down, the nib 122 is freely extended out of the housing 110 for use by making use of the push of the knock element 130, and when the locking element 150 is moved up, the downward movement of the knock element 130 is limited by the position of the locking element 150, so when the knock type pen 100 is in non-use, even though an unintended force is applied to the knock element 130, the knock element 130 does not move, thereby preventing the nib 122 from being unintentionally pushed out.

Furthermore, as the fixing section 144 bent downward is formed on the top of the guide groove 140 of the regulating element 140, when the protrusion 154 of the locking element 150 moves up along the movement section 142 of the guide groove 140 and is inserted into the fixing section 144 bent downward from the top of the movement section 142, the protrusion 154 is less likely to slip, thereby limiting the pressing of the knock element 130 more securely.

In addition, describing with reference to FIG. 5, the knock type pen 100 according to an embodiment of the present disclosure may further include a lock display section 160 to display the lock state of the knock element 130 resulting from the rotation of the regulating element 140. The lock display section 160 includes each one lock display 162 on the outer surface adjacent to the boundary between the housing 110 and the regulating element 140, and when the two lock displays 162 are in contact with each other or close to each other, it can be seen that the locking element 150 moves up and the pressing of the knock element 130 is limited. Although this embodiment shows the lock display 162 as a triangular figure, the shape of the lock display 162 is not limited thereto, and each lock display 162 may be manufactured in various shapes such as characters, symbols or numbers.

While the present disclosure has been described with reference to the embodiments illustrated in the figures, the embodiments are merely examples, and it will be understood by those skilled in the art that various changes in form and other embodiments equivalent thereto can be performed. Therefore, the technical scope of the disclosure is defined by the technical idea of the appended claims The drawings and the forgoing description gave examples of the present invention. The scope of the present invention, however, is by no means limited by these specific examples. Numerous variations, whether explicitly given in the specification or not, such as differences in structure, dimension, and use of material, are possible. The scope of the invention is at least as broad as given by the following claims.

What is claimed is:

1. A knock type pen comprising a housing, a lead which is received in the housing, and a knock element protruding from top of the housing, wherein a nib at an end of the lead operates such that the nib is pushed in and out of a bottom of the housing by a pressing motion of the knock element, the knock type pen comprising:

a regulating element which is rotatably installed on an outer circumference of the housing; and a locking element which is received in the housing and moves up and down by a rotation motion of the regulating element, wherein when the locking element moves up, a press of the knock element is limited by the locking element.

2. The knock type pen of claim 1, wherein a guide groove of an oblique line is formed on an inner circumference of the regulating element, wherein the locking element comprises a blocking section which is installed in an inner side of the housing, and a protrusion which protrudes from an outer side of the blocking section and is inserted into the guide groove of the regulating element, and is installed in the housing to make a linear motion upward and downward.

3. The knock type pen of claim 2, wherein the guide groove has a movement section of an oblique line and a fixing section bent downward from top of the movement section.

* * * * *